US005920927A

United States Patent [19]

Thomas

[11] Patent Number: 5,920,927

[45] Date of Patent: Jul. 13, 1999

[54] PORTABLE SHOWER AND TOILET ASSEMBLY

[76] Inventor: John R. Thomas, 3586 Barns Rd., Rineyville, Ky. 40162

[21] Appl. No.: 09/083,067

[22] Filed: May 21, 1998

[51] Int. Cl.[6] ..... A47K 3/22; A47K 11/02

[52] U.S. Cl. ..... 4/599; 4/460; 4/449; 4/597

[58] Field of Search ..... 4/449, 460, 476, 4/479, 484, 597, 599, 600, 602, 603, 612

[56] References Cited

U.S. PATENT DOCUMENTS

| | | | |
|---|---|---|---|
| 997,270 | 7/1911 | Cofrode | 4/460 |
| 1,104,314 | 7/1914 | Rench | 4/599 |
| 1,425,391 | 8/1922 | Munyon | 4/460 |
| 1,577,595 | 3/1926 | Smith | 4/460 |
| 2,418,915 | 4/1947 | Volk | 4/597 |
| 2,540,411 | 2/1951 | Wright | 4/599 |
| 3,391,409 | 7/1968 | Gatley | 4/599 |
| 5,205,001 | 4/1993 | O'Connell . | |
| 5,287,569 | 2/1994 | Johnson . | |
| 5,311,620 | 5/1994 | Ratje . | |
| 5,379,466 | 1/1995 | Davies . | |
| 5,446,930 | 9/1995 | Clark . | |
| 5,469,587 | 11/1995 | Demeny . | |

FOREIGN PATENT DOCUMENTS

| | | | |
|---|---|---|---|
| 19430 | 9/1934 | Australia | 4/460 |
| 2671961 | 7/1992 | France | 4/597 |

*Primary Examiner*—Charles R. Eloshway
*Attorney, Agent, or Firm*—Kenneth L. Toler

[57] ABSTRACT

A portable shower and toilet assembly includes a support structure having substantially square upper and lower horizontal tubular frame components which are connected with vertical tubular side supports. The upper frame member has a cross member in fluid communication therewith with a shower head downwardly depending therefrom. An external water source may be coupled with an aperture on the upper frame component to dispense water through the shower head. A toilet seat and lid are hingedly attached to a side wall structure. The support structure is completely enclosable with a removably attached tarpaulin cover member.

8 Claims, 1 Drawing Sheet

PORTABLE SHOWER AND TOILET ASSEMBLY

BACKGROUND OF THE INVENTION

The present invention provides a portable, enclosable shower and toilet assembly for use by those in an outdoor, remote location.

DESCRIPTION OF THE PRIOR ART

Campers, boaters, hunters, fishermen and those participating in similar outdoor activities are generally in a remote location for extended periods of time where public toilets and showers are frequently not accessible. However, there are often other people in the vicinity so that bathing in the open is not an option. Accordingly, there is currently a need for a portable, easy-to-assemble enclosure which allows a user to privately shower or use a toilet therein.

Various portable shower or toilet assemblies exist in the prior art. For example, U.S. Pat. No. 5,469,587 Demeny discloses a portable emergency decontamination shower. The device includes several connected frame sections each formed of a plurality of flexible hoses. The frame sections are connected with support posts each having a plurality of spray nozzles thereon in communication with a water inlet.

U.S. Pat. No. 5,446,930 issued to Clark discloses a portable shower enclosure formed of a base and an upper shower ring having spray nozzles thereon. The base and ring each have sockets directed slightly outward from the vertical. Pipes are fitted into the sockets and are slightly flexed, one of which has a water inlet. The base is hollow for receiving water to stabilize the device.

U.S. Pat. No. 5,379,466 issued to Davies relates to a portable, vertically collapsible privacy closet that when raised provides a toilet or changing facility and when lowered provides a weather tight storage area. The device includes an upper section telescopingly received within a lower section and is moved up and do wn with a cable assembly.

U.S. Pat. No. 5,311,620 issued Ratje discloses an outdoor portable shower including a one piece inflatable enclosure anchored to the ground with stakes or alternatively by filling a bottom ring with water. Fastened between the top and bottom rings is a sheet vinyl wall for enclosing the interior.

U.S. Pat. No. 5,287,569 issued to Johnson discloses a portable shower apparatus including a rectilinear framework having a flexible shower curtain secureable thereabout and a bottom mounted floor shield and plate structure. The shower apparatus includes a heating assembly and an electric pump for directing fluid through the framework.

U.S. Pat. No. 5,208,001 issued to O'Connell discloses a portable collapsible shower for accommodating invalids having an expandable shower enclosure unit which extends substantially vertically and a bottom which is sealingly connected with the shower enclosure to capture water and to prevent its spillage.

Although various portable toilet and shower assemblies exist in the prior art, none relate to a uniquely designed structure that provides a portable, enclosable shower having a toilet seat therein that is pivotable to a storage position when a person wishes to shower. Furthermore, the portable enclosure according to the present invention is lightweight, inexpensive to manufacture, easily disassembled and includes minimal component parts.

SUMMARY OF THE INVENTION

The present invention relates to a portable enclosure which allows a user to privately shower or use a toilet therein. The device comprises a support structure formed of upper and lower, substantially square horizontal frame components preferably constructed with PVC pipe or a similar lightweight material. A vertical tubular side support extends from each comer of the upper frame component to a corresponding comer on the lower frame component. Preferably, each support leg is formed of two separable segments to facilitate disassembly and storage of the device. On a side of the upper frame component is an aperture for coupling with an external water source such as a hose or pipe. The upper frame component has a cross member extending from one side to an opposing, parallel side which is in fluid communication with the water inlet aperture. Downwardly depending from the lower surface of the cross member is a shower head. Disposed about the outwardly facing side of the upper frame component are a plurality of spaced bolts for securing a tarpaulin enclosure. The tarpaulin enclosure is elongated and substantially rectangular having a plurality of aligned grommets along the longitudinal top edge thereof which received the bolts on the upper frame component to secure the cover about the periphery of the support structure. The structure further includes a frame structure between two side supports having a toilet seat and lid hingedly attached thereto at a height sufficient to place a waste receptacle thereunder. The entire structure may be anchored to the ground with tie down ropes and stakes. It is therefore an object of the present invention to provide a portable shower and toilet assembly that is easy to assemble and inexpensive to manufacture.

It is yet another object of the present invention to provide a portable shower and toilet assembly which may be quickly and easily disassembled for storage.

It is yet another object of the present invention to provide a portable shower and toilet assembly that allows a user to privately bathe or use a toilet in public. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
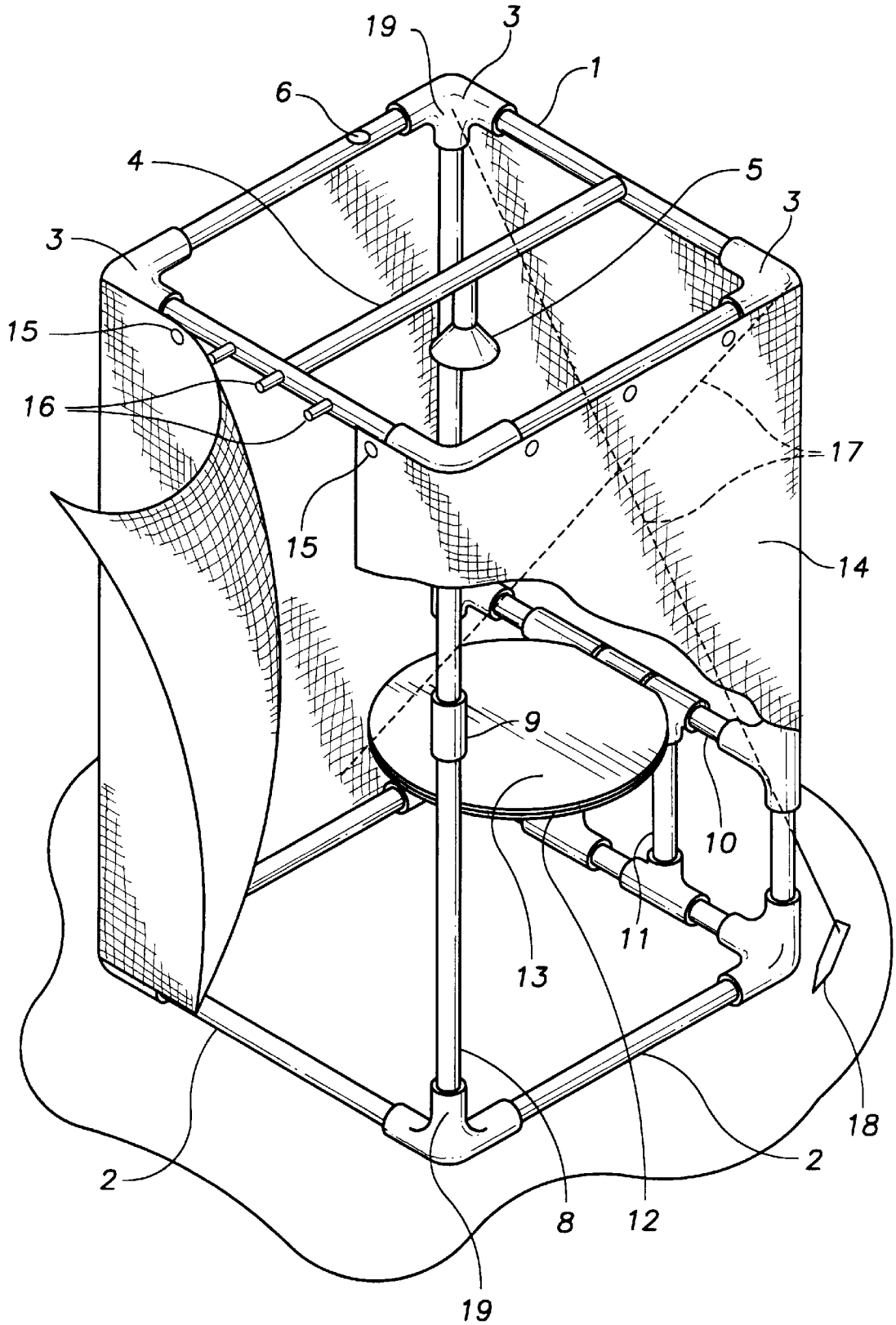
FIG. 1 depicts the inventive device with a partial cut away view of the tarpaulin cover revealing the interior of the support structure.

Referring now to FIG. 1, the present invention provides a portable shower and toilet assembly for use by campers and others participating in remote outdoor activities. The device comprises a vertically oriented support structure including an upper frame component 1 and a lower frame component 2. Each frame component is substantially square having four sides and is formed of four tubular members interconnected with four threadedly engaging, ninety degree elbows 3. The elbows on the upper frame member each have a downwardly depending socket 19 axially aligned with an upwardly depending socket on the lower frame member elbow. Preferably the tubular members and the elbows are constructed with hollow PVC piping or a similar lightweight material. Each tubular member on the upper frame component has a plurality of aligned bolts 16 or similar projections extending horizontally from its outwardly facing side.

The upper frame component has a hollow tubular cross member 4 extending from one side to an opposing, parallel side. Downwardly depending from the lower surface of the cross member is a shower head 5 preferably having a valve means (not pictured) adjacent thereto. A third side has an aperture 6 thereon in fluid communication with the shower head. An external water source such as a hose or pipe may be coupled with the aperture using conventional means for delivering water through the shower head. The aperture may be threaded to receive any conventional type of conduit coupling device.

The upper and lower frame members are interconnected with a plurality of vertical, tubular side supports 8 having two opposing ends. A first end of each side support is received within an elbow socket on the top frame component with the opposing end received within the opposing axially aligned socket on the lower frame component. Each vertical side support is preferably formed of two mating, half-segments coaxially aligned and joined with a pipe coupling 9. The two-part side support may be easily separated to facilitate the disassembly and storage of the device.

The support structure further includes a side frame assembly comprising a horizontal tubular member 10 disposed between a pair of adjacent side supports and parallel to and spaced a predetermined distance from a side of the lower frame component. A pair of vertical posts 11 are disposed between the horizontal tubular member and the spaced side of the lower frame component to rigidly support the horizontal tubular member. Hingedly attached to the horizontal tubular member is a toilet seat 12 and a lid 13 each having a similar peripheral configuration superimposed thereon and each being independently pivotable. The horizontal tubular member and thus the attached toilet seat and lid are spaced a predetermined distance to allow a waste collection receptacle such as a five gallon bucket (not pictured) to fit therebelow. The toilet seat may be further supported in a horizontal position with ropes, cords or similar means. The toilet seat and lid may be secured to the horizontal tubular member with pivoting clamps or a similar means. Accordingly, the lid and seat may be pivoted to a horizontal position when the enclosure is to be used as a toilet or to a vertical, stored position when the enclosure is used as a shower. The support structure is completely enclosable with an elongated substantially rectangular opaque tarpaulin cover member 14 having top and bottom longitudinal edges. The cover member has a plurality of aligned grommets 15 along the top edge thereof for receiving the bolts on the outwardly facing side of the upper frame member to secure the cover member to the support structure. The tarpaulin cover member is dimensioned to completely enclose the support structure when wrapped thereabout.

The structure may be anchored to the ground with a plurality of tie down ropes 17, cords or cables. An end of each rope is secured to the upper frame component and the rope is extended outwardly from the support structure using conventional attachment means. A stake or anchor 18 is secured to the opposing end of the rope and is inserted into the ground to stabilize the structure.

As previously mentioned, the support structure is preferably constructed with PVC piping or a similar material while the cover member is preferably constructed with a tarpaulin plastic or canvas material. Preferably, the various tubular components are threadedly coupled although any conventional fastening method may be used. The toilet seat is conventional and is preferably constructed with plastic or a similar lightweight material. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable shower and toilet assembly comprising:

a support structure including horizontal, substantially square upper and lower frame components interconnected with a plurality of vertical side supports, said upper frame component having an aperture on a side thereof for coupling with an external water source, said upper frame component further including a cross member extending from a first side to an opposing parallel side with a shower head downwardly depending therefrom, wherein said shower head is in fluid communication with said aperture so that water from said external source may be delivered therethrough;

an opaque, substantially rectangular cover member having top and bottom longitudinal edges with the top longitudinal edge removably secured to said upper frame component to form a peripheral enclosure about said support structure;

a horizontal tubular member disposed between two adjacent vertical side supports spaced a predetermined height from said lower frame component;

a toilet seat hingedly attached to said horizontal tubular member movable between a horizontal position in which said seat extends into said support structure when said assembly is used as a toilet and a vertical position for storage when said assembly is used as a shower; and a pair of vertical posts diposed between said horizontial tubular member and the lower frame component to rigidy support the horizontal tubular member.

2. A device according to claim 1 wherein said upper frame component further comprises a plurality of projections extending therefrom.

3. A device according to claim 2 wierein said cover member has a plurality of aligned grommets adjacent the top edge thereof dimensioned to removably receive said projections to secure the cover member to the support structure.

4. A device according to claim 1 further comprising a plurality of ropes secured to the upper frame component, each rope having an anchoring means at a distal end for anchoring said support structure to the ground.

5. A device according to claim 1 wherein said vertical side supports each include two removably coupled segments to facilitate the assembly, disassembly, transportation, and storage of said support structure.

6. A device according to claim 1 further comprising a lid component, overlaying said toilet seat and having a substantially similar peripheral configuration as said toilet seat, said lid component hingedly attached to said horizontal tubular member and independently pivotable relative to said toilet seat.

7. A device according to claim 1 wherein said upper and lower frame components and said vertical side supports are constructed with hollow PVC piping.

8. A device according to claim 1 wherein said vertical side supports are threadedly coupled to said upper and lower frame components and said horizontal tubular member to facilitate the assembly, disassembly, transportation, and storage of said support structure.

* * * * *